US005684258A

United States Patent [19]

Liao

[11] Patent Number: 5,684,258

[45] Date of Patent: Nov. 4, 1997

[54] DEVICE HOLDER FOR DRUMS

[75] Inventor: Tsun-Chi Liao, Taichung, Taiwan

[73] Assignee: Hwa Shi Musical Instrument Co., Ltd., Taichung, Taiwan

[21] Appl. No.: 641,582

[22] Filed: May 1, 1996

[51] Int. Cl.[6] ..... G10D 13/02

[52] U.S. Cl. ..... 84/421; 84/453; 224/910; 248/316.2; 248/316.5

[58] Field of Search ..... 84/421, 453, 402, 84/422.1, 422.2; 224/910; 248/316.5, 316.2

[56] References Cited

U.S. PATENT DOCUMENTS 892,105 6/1908 White ..... 84/421

1,495,672 5/1924 Cheney ..... 84/421

2,063,924 12/1936 Hanko ..... 248/316.5

4,702,447 10/1987 Westwood, III ..... 248/316.5

*Primary Examiner*—Cassandra C. Spyrou

*Attorney, Agent, or Firm*—Bacon & Thomas

[57] ABSTRACT

A device holder which includes a substantially L-shaped holder base having a horizontal mounting portion adapted for fastening to the counterhoop of a drum and a vertical holder portion with a cup-like head, a grooved cone supported on a spring in the cup-like head and secured to the cup-like head by an eye-end screw and a wing nut to hold a link and a device on the link, and a curved clamping plate turned about a pivot on the vertical holder portion of the holder base and adjustably fixed to the holder base by a screw bolt and a wing nut to secure the horizontal mounting portion of the holder base to the counterhoop of the drum.

4 Claims, 10 Drawing Sheets

DEVICE HOLDER FOR DRUMS

BACKGROUND OF THE INVENTION

The present relates to percussion instrument, and relates more particularly to a device holder adapted for fastening to a drum to hold an instrument.

FIG. 1 shows a device holder adapted for securing to the counterhoop of a drum to hold a device. This device holder comprises a smoothly curved mounting portion at one end and a smoothly curved clamping portion disposed at one end adapted for fastening to the counterhoop of a drum, and an elongated coupling slot at an opposite end for mounting a bolt to hold a crank rod and a device on the crank rod. The mounting portion and the clamping portion are respectively made with transverse grooves on the inside so that the mounting portion and the clamping portion can be firmly clamped on the counterhoop of the drum. However, because the clamping mouth defined between the mounting portion and the clamping portion is not adjustable, this device holder does not fit different drums of different counterhoops. Furthermore, when the crank rod is installed, its angular position cannot be adjusted relative to the drum, therefore the device which is mounted on the crank rod cannot be adjusted to the desired angle.

SUMMARY OF THE INVENTION

According to one aspect of the present invention, the device holder is comprised of a substantially L-shaped holder base having a horizontal mounting portion adapted for fastening to the counterhoop of a drum and a vertical holder portion with a cup-like head adapted for the mounding of a link to hold a device, and a curved clamping plate turned about a pivot on the vertical holder portion of the holder base and adjustably fixed to the holder base by a screw bolt and a wing nut to secure the horizontal mounting portion of the holder base to the counterhoop of the drum. By adjusting the screw bolt, the clamping mouth defined between the horizontal mounting portion of the holder base and the clamping plate is relatively adjusted. According to another aspect of the present invention, a grooved cone is supported on a spring in the cup-like head of the vertical holder portion of the holder base and secured to the cup-like head by an eye-end screw and a wing nut to hold a link in a vertical groove at the back side of the cone and a device on the link. The eye-end screw has an internally toothed eye at one end for securing any of a variety of links to hold any of a variety of devices.

DETAILED DESCRIPTION OF THE PREFERRED EMBODIMENT

Figure 1:
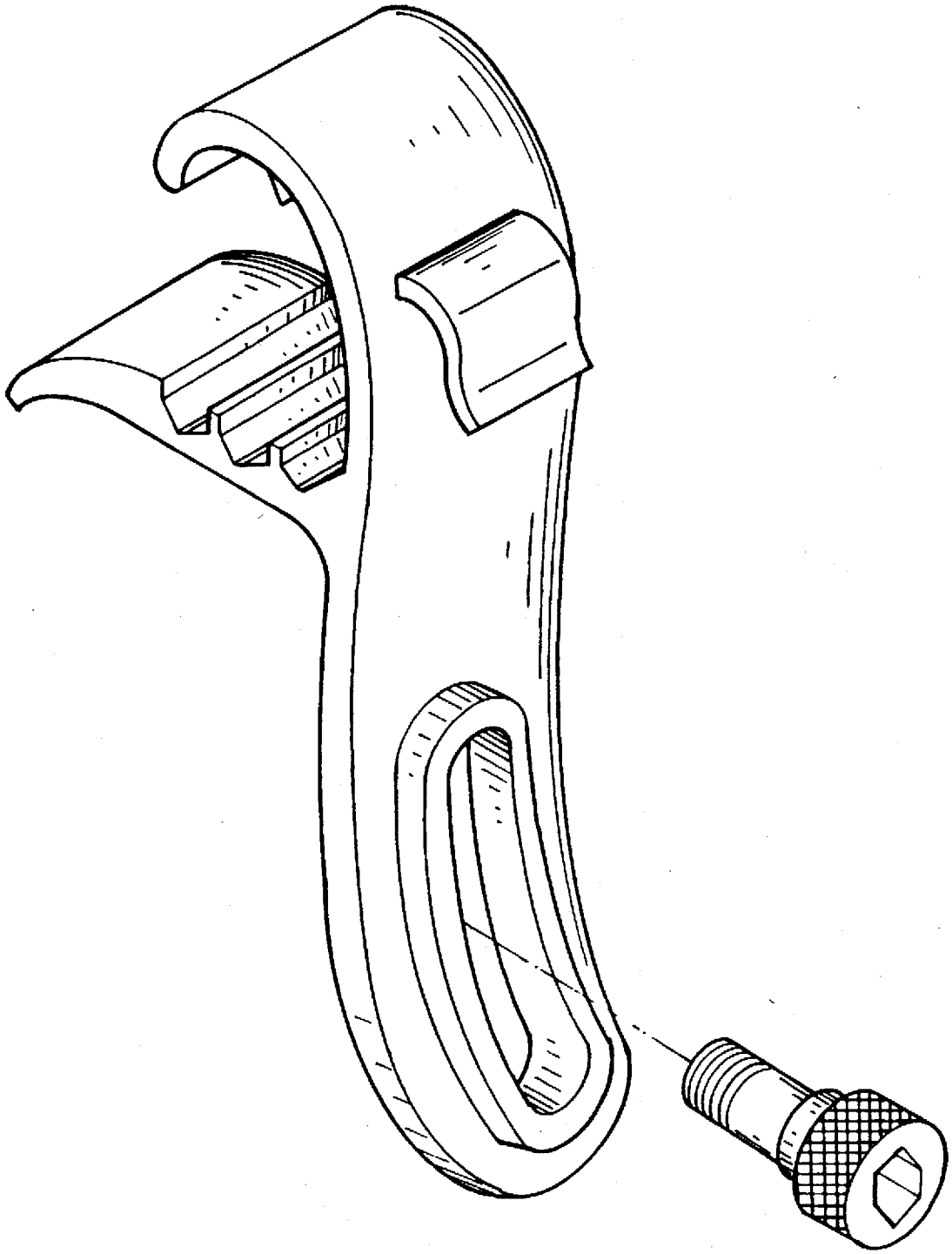
Fig. 1 PRIOR ART
FIG. 1 shows a device holder for drums according to the prior art.
Figure 2:
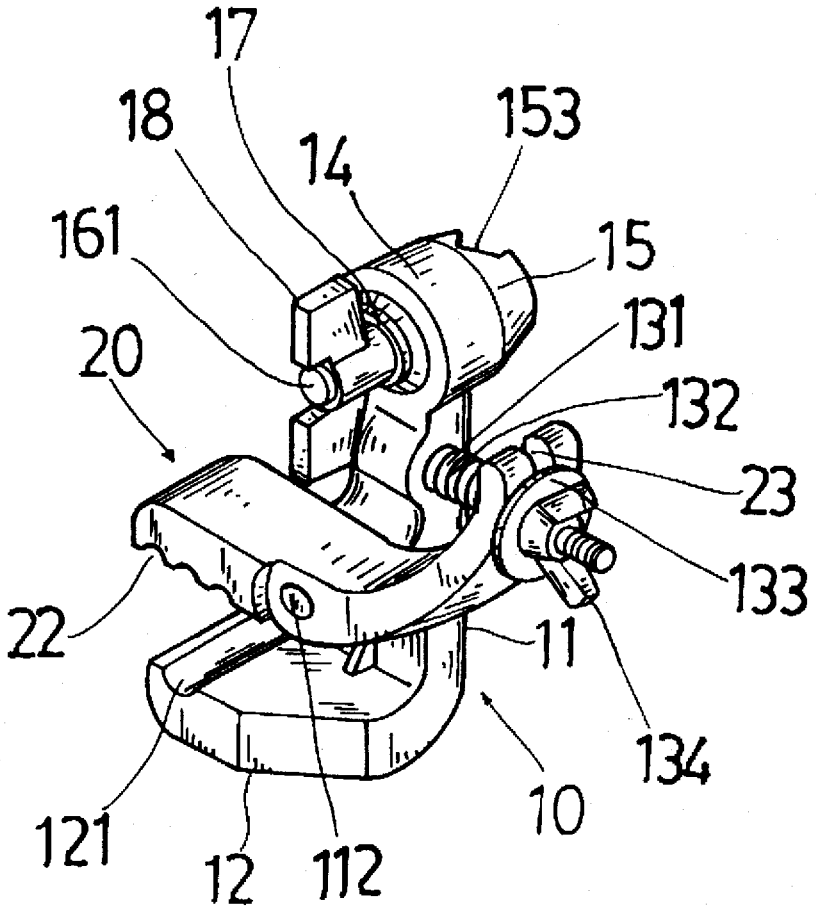
FIG. 2 is an elevational view of a device holder according to the present invention.
Figure 3:
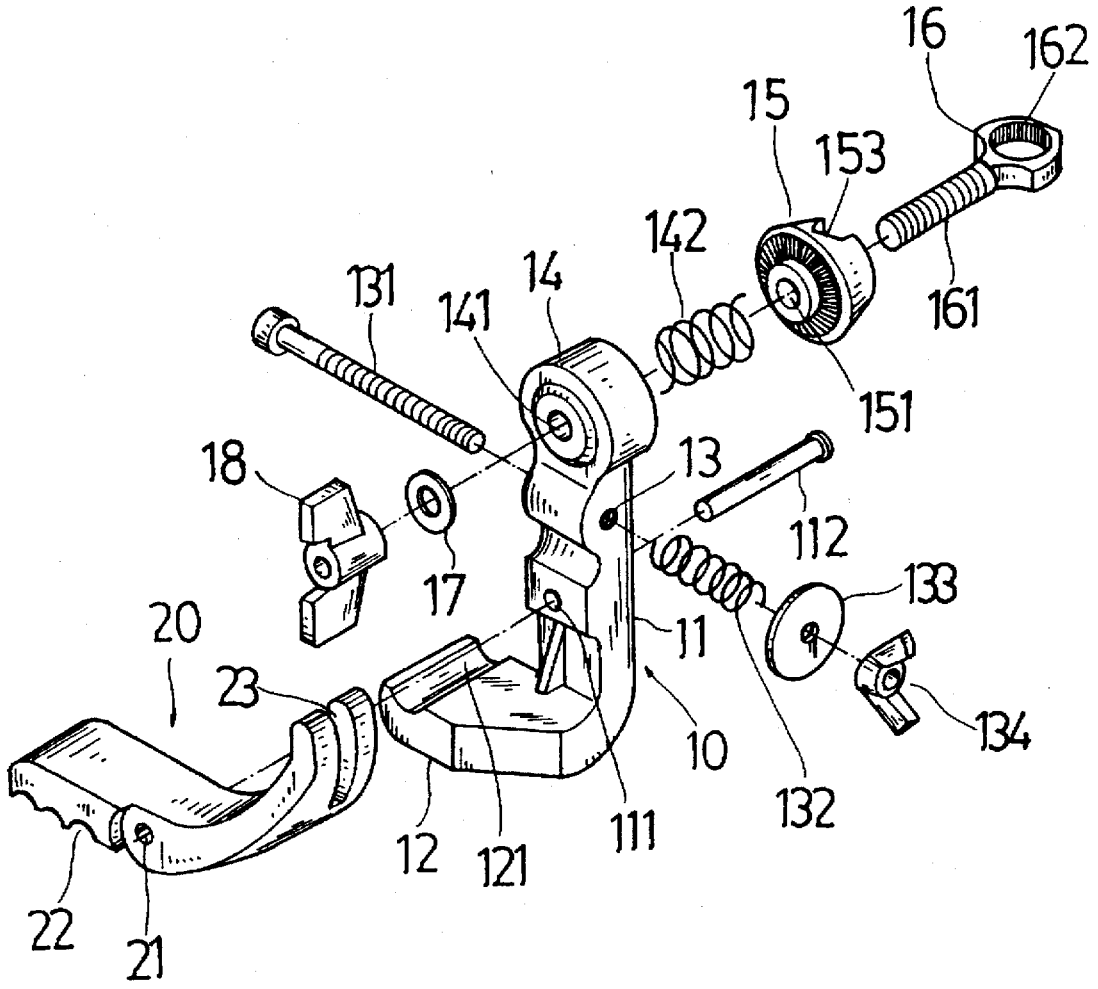
FIG. 3 is an exploded view of the device holder shown in FIG. 2.
Figure 4A:
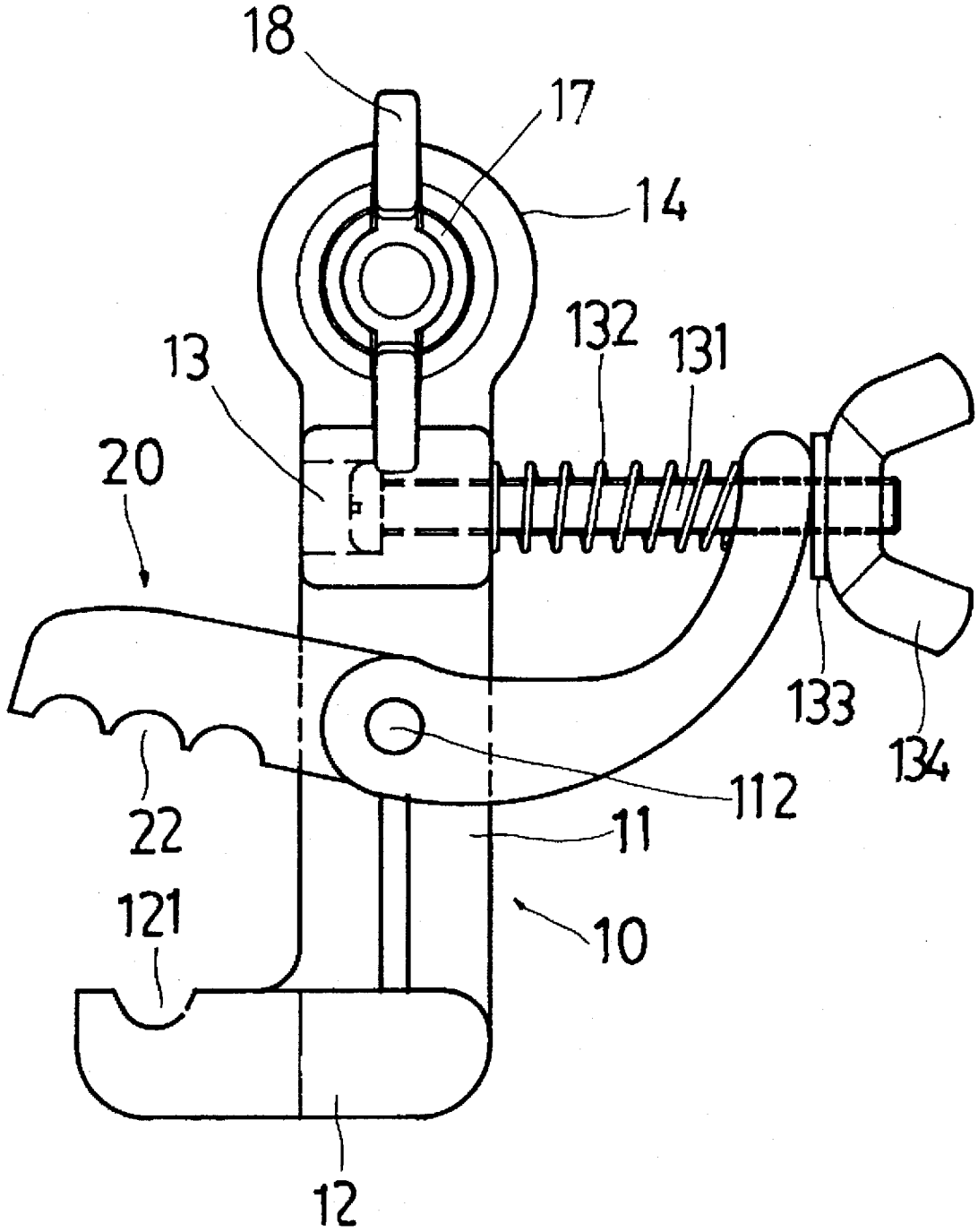
FIG. 4A is a front plain view of the device holder shown in FIG. 2.
Figure 4B:
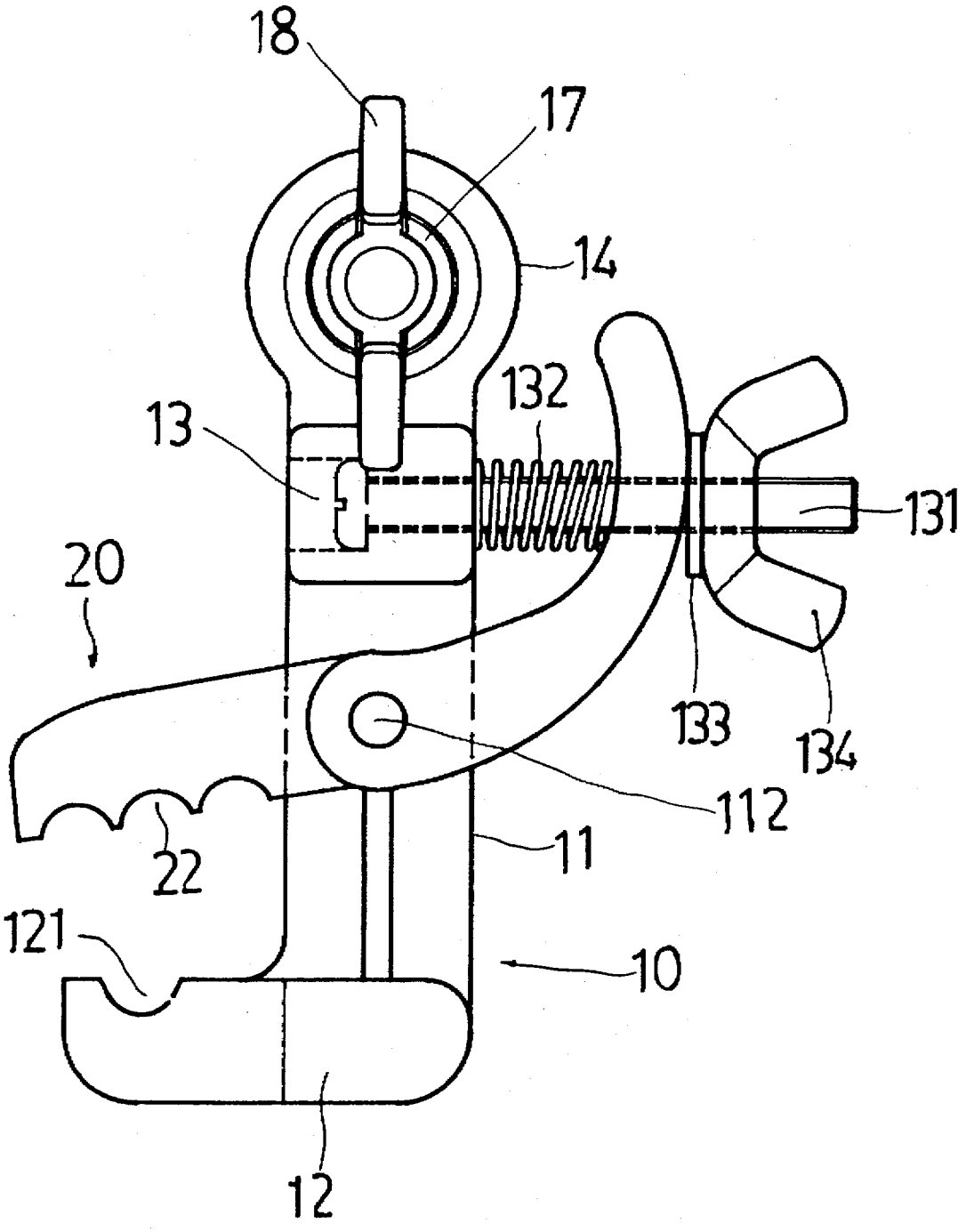
FIG. 4B is similar to FIG. 4A but showing the angular position of the curved clamping plate adjusted relative to the horizontal mounting portion of the holder base.

Referring to FIGS. 2, 3, 4A, and 4B, a device holder in accordance with the present invention comprises a substantially L-shaped holder base 10, and a curved clamping plate 20. The L-shaped holder base 10 comprises a vertical holder portion 11, and a horizontal mounting portion 12 extending from the vertical holder portion 11 at right angles. A transverse mounting groove 121 is transversely disposed at the top side of the horizontal mounting portion 12 remote from the vertical holder portion 11. A pivot hole 111 is made through the vertical holder portion 11 adjacent to the horizontal mounting portion 12. A pivot 112 is fastened to the pivot hole 111 to hold the curved clamping plate 20. The curved clamping plate 20 is turned about the pivot 112, having a transverse pivot hole 21 in the middle, which receive the pivot 112, and a plurality of parallel mounting grooves 22 transversely disposed at the bottom side near one end thereof. The opposite end of the curved clamping plate 20 is slightly turned sideways and made with a longitudinal coupling slot 23. An axle hole 13 is made on the vertical holder portion 11 of the holder base 10 above the elevation of the pivot hole 111. A screw bolt 131 is inserted through the axle hole 13 of the vertical holder portion 11 of the holder base 10 and the longitudinal coupling slot 23 of the curved clamping plate 20 and then screwed up with a wing nut 134. A coil spring 132 is mounted around the screw bolt 131 and stopped between the vertical holder portion 11 and the curved clamping plate 20. A washer 133 is mounted around the screw bolt 131 and stopped between the curved clamping plate 20 and the wing nut 134. The angular position of the curved clamping plate 20 can be conveniently adjusted by turning the wing nut 134 relative to the screw bolt 131. When the wing nut 134 is loosened, the coil spring 132 is relatively released to force the curved clamping plate 20 outwards, causing the curved clamping plate 20 to turn about the pivot 112 in one direction, and therefore the mounting grooves 22 of the curved clamping plate 20 are moved upwards from the mounting groove 121 of the horizontal mounting portion 12 of the holder base 10 (see FIG. 4A). On the contrary, when the wing nut 134 is turned inwards, the curved clamping plate 20 is forced inwards to compress the coil spring 132 and turned about the pivot 112 in the reversed direction, and therefore the mounting grooves 22 of the curved clamping plate 20 are moved downwards toward the mounting groove 121 of the horizontal mounting portion 12 of the holder base 10 (see FIG. 4B). Therefore, by means of the aforesaid adjusting procedure, the mounting grooves 22 of the curved clamping plate 20 and the mounting groove 121 of the horizontal mounting portion 12 can be firmly secured to the counterhoop 30 of a drum (see FIG. 7).

Figure 5:
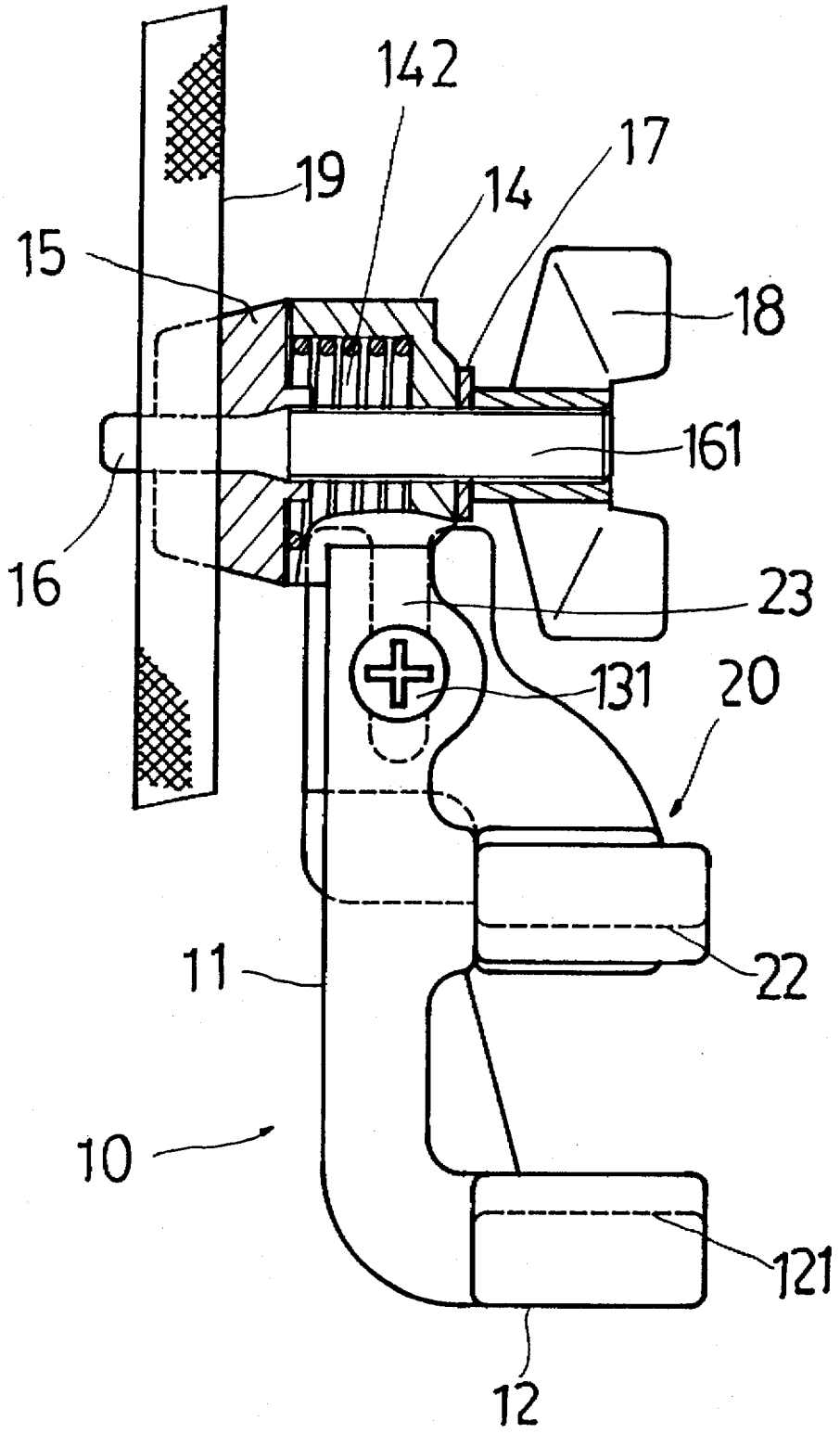
FIG. 5 is a sectional view of the present invention showing a link fastened to the eye-end screw.
Figure 6:
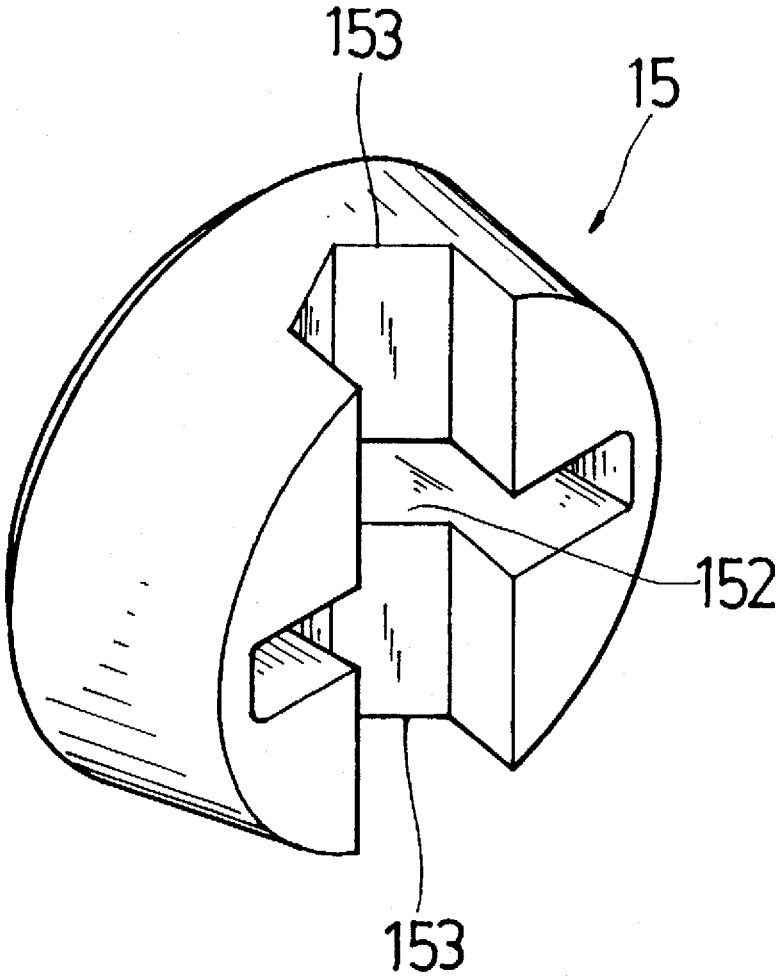
FIG. 6 is an elevational view of the cone of the device holder shown in FIG. 2, showing the back side structure thereof.

Referring to FIGS. 5 and 6, the vertical holder portion 11 of the holder base 10 has a top end terminating in a cup-like head 14 having a center through hole 141. A spring 142 is mounted within the cup-like head 14 of the vertical holder portion 11. A cone 15 is fastened to the cup-like head 14 to hold down the spring 142 by an eye-end screw 16, a washer 17 and a wing nut 18. The cone 15 comprises a transverse groove 152 and a vertical groove 153 of polygonal cross section intersected at one side, and a center axle hole 151 at the intersected point between the transverse groove 152 and the vertical groove 153. The eye-end screw 16 comprises a screw body 161 inserted through the center axle hole 151 of the cone 15 and the center through hole 141 of the cup-like head 14 of the vertical holder portion 11 of the holder base 10 and screwed up with the wing nut 18, and an internally toothed eye 162 at one end of the screw body 161 forced into engagement with the transverse groove 152 of the cone 15 to hold a link 19 in the vertical groove 153.

Figure 7:
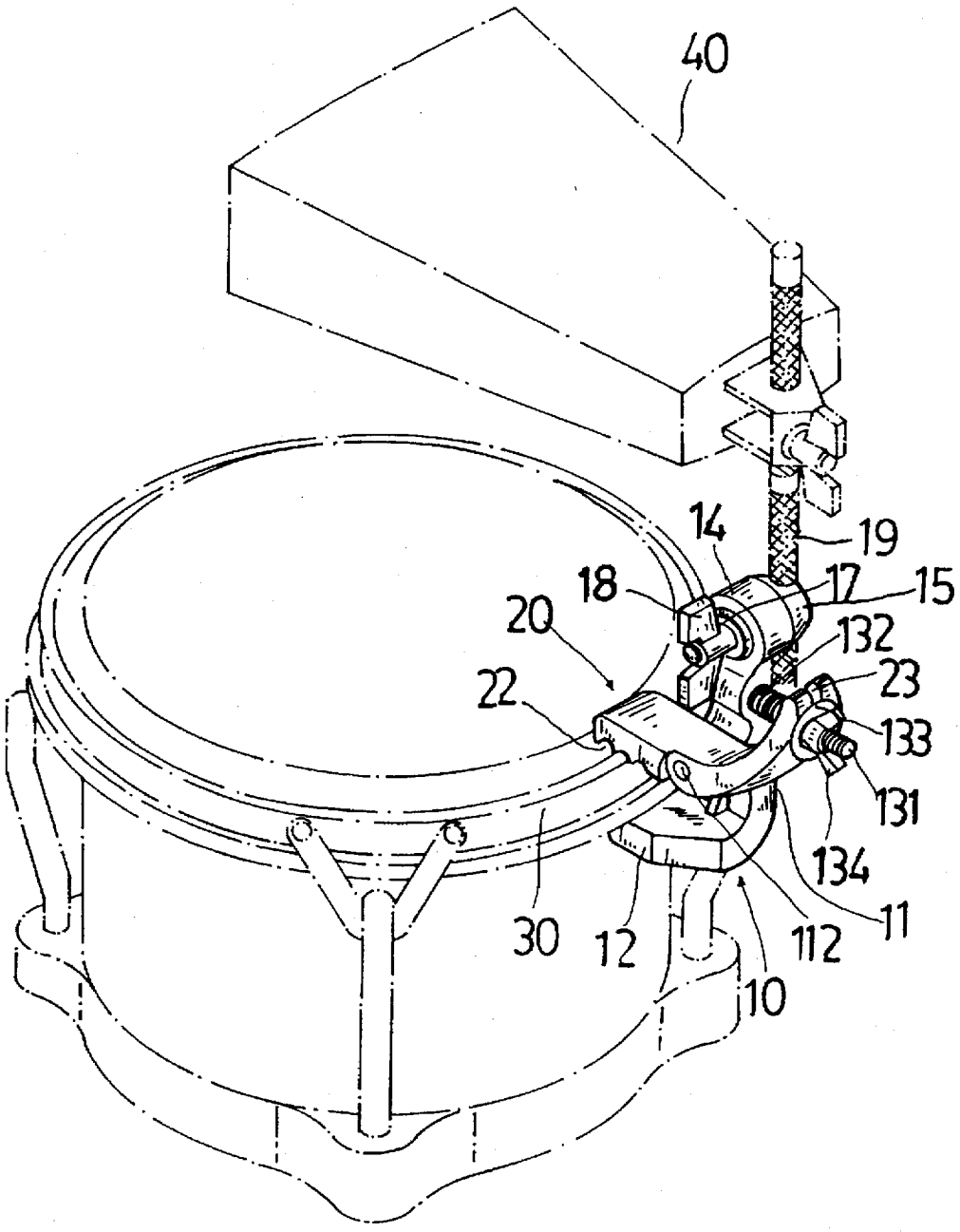
FIG. 7 is an applied view of the present invention, showing the device holder fastened to the counterhoop of a drum to hold a cowbell.
Figure 8:
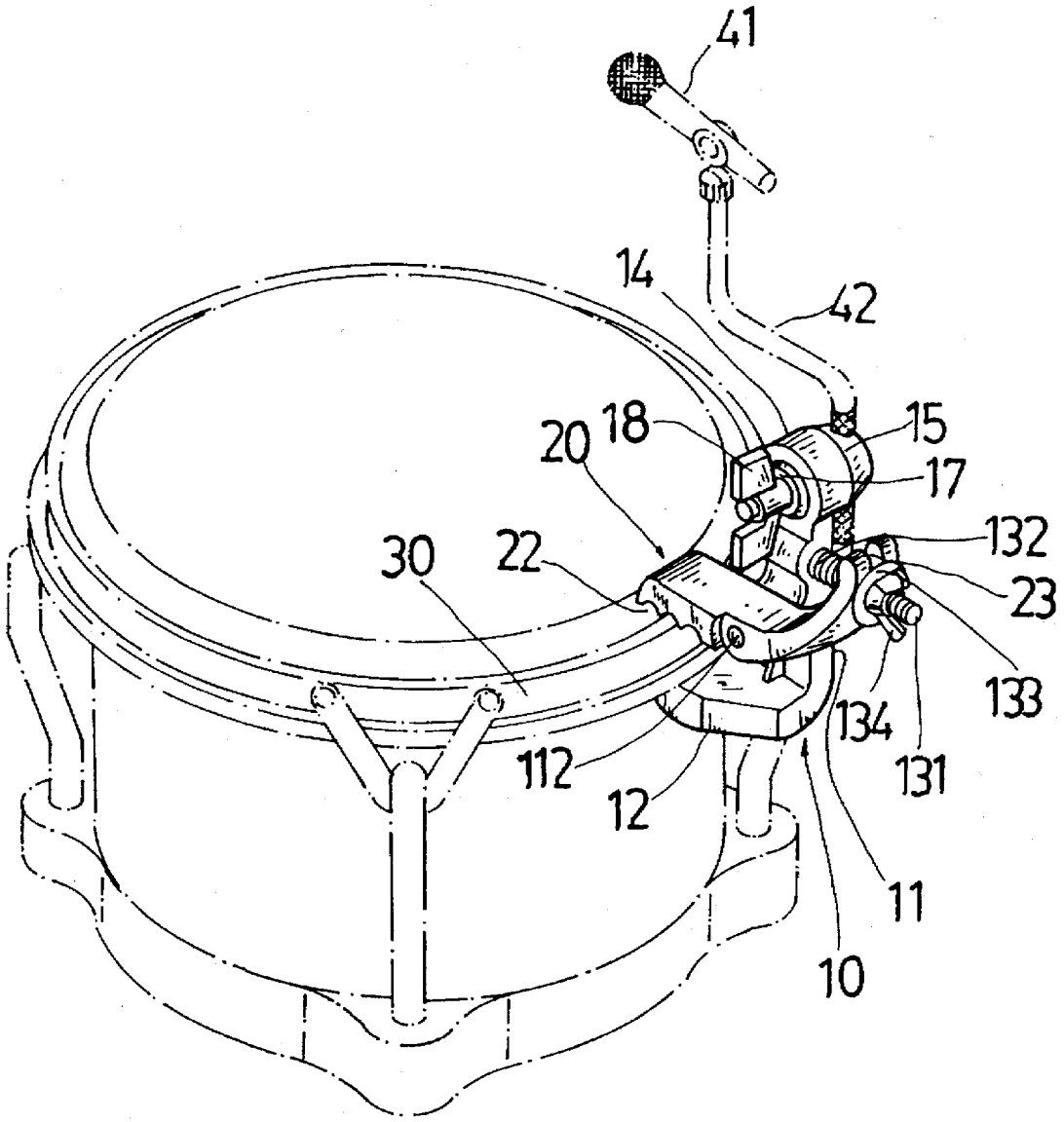
FIG. 8 is another applied view of the present invention, showing the device holder fastened to the counterhoop of a drum to hold a microphone.
Figure 9:
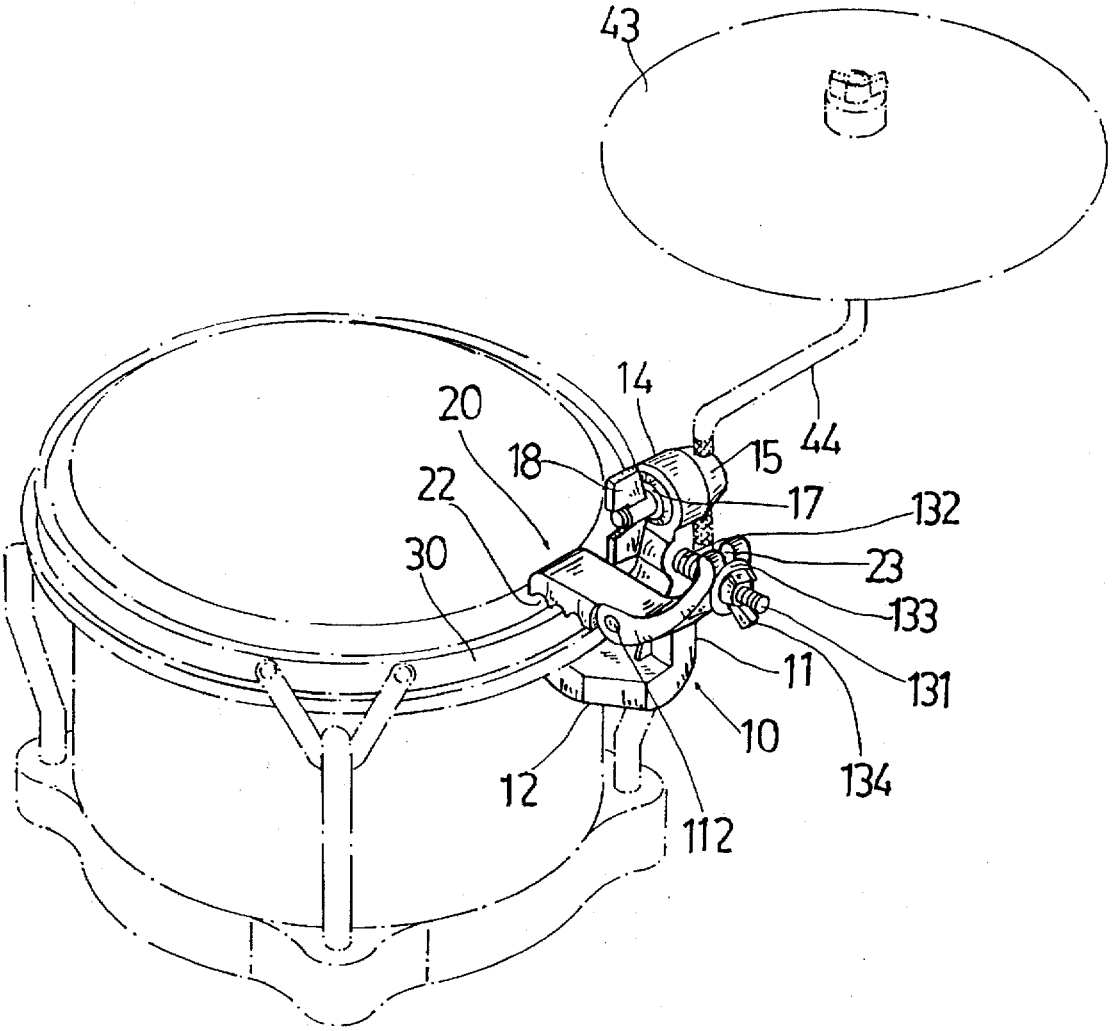
FIG. 9 is still another applied view of the present invention, showing the device holder fastened to the counterhoop of a drum to hold a cymbal.

FIG. 7 shows an applied view of the present invention in which a link 19 is fastened to the cone 15 by the eye-end screw 16 to hold a cowbell 40. FIG. 8 shows another applied view of the present invention, in which a link 42 is fastened to the cone 15 by the eye-end screw 16 to hold a microphone 41. FIG. 9 shows still another applied view of the present invention, in which a link 44 is fastened to the cone 15 by the eye-end screw 16 to hold a cymbal 43.

I claim:

1. A device holder comprising:

a substantially L-shaped holder base, said holder base comprising a vertical holder portion, a horizontal mounting portion extending from said vertical holder portion at right angles, a transverse mounting groove transversely disposed at said horizontal mounting portion remote from said vertical holder portion for clamping on the counterhoop of a drum, a pivot hole through said vertical holder portion, an axle hole in said vertical holder portion above said pivot hole, a cup-like head raised from said vertical holder portion remote from said horizontal mounting portion, and a through hole at the center of said cup-like head;

a pivot fastened to the pivot hole of said vertical holder portion;

first fastening means, said first fastening means comprising a screw bolt inserted through the axle hole of said vertical holder portion of said holder base, a wing nut threaded onto said screw bolt to secure said screw bolt to said vertical holder portion, a spring and a washer mounted around said screw bolt and disposed between said vertical holder portion of said holder base and the wing nut of said first fastening means;

second fastening means fastened to said cup-like head to hold a link and an instrument on said link, said second fastening means comprising a spring mounted within said cup-like head, a cone fastened to the through hole of said cup-like head to hold down the spring of said second fastening means by an eye-end screw, a washer and a wing nut, said cone comprising a transverse groove and a vertical groove intersected at one side, and a center axle hole at the intersected point between said transverse groove and said vertical groove, said eye-end screw comprising a screw body inserted through the center axle hole of said cone and the center through hole of said cup-like head and screwed up with the wing nut of said second fastening means, and an eye at one end of said screw body forced into engagement with said transverse groove of said cone to hold the link in said vertical groove; and a curved clamping plate turned about said pivot and fixed in place by said first fastening means to clamp with the horizontal mounting portion of said holder base on the counterhoop of the drum.

2. The device holder of claim 1 wherein said curved clamping plate is turned about said pivot, comprising a pivot hole in the middle which receives said pivot, a plurality of transverse mounting grooves at one end adapted for clamping with the transverse mounting groove of said horizontal mounting portion of holder base on the counterhoop of the drum, and a longitudinal coupling slot at an opposite end coupled to said screw bolt.

3. The device holder of claim 1 wherein said vertical groove of said cone of said second fastening means has a polygonal cross section.

4. The device holder of claim 1 wherein the eye of said eye-end screw is internally toothed.

* * * * *